US012114749B1

(12) United States Patent
Schinasi

(10) Patent No.: US 12,114,749 B1
(45) **Date of Patent: *Oct. 15, 2024**

(54) FOLDABLE TOTE BAG WITH COLLAPSIBLE CONTAINER BODY

(71) Applicant: Codefine International SA, La Tour-de-Peilz (CH)

(72) Inventor: Piero Schinasi, La Tour-de-Peilz (CH)

(73) Assignee: Codefine International SA, La Tour-de-Peilz (CH)

( * ) Notice: Subject to any disclaimer, the term of this patent is extended or adjusted under 35 U.S.C. 154(b) by 0 days.

This patent is subject to a terminal disclaimer.

(21) Appl. No.: 18/608,036

(22) Filed: Mar. 18, 2024

(30) Foreign Application Priority Data

Jan. 29, 2024 (EP) ..... 24154490

(51) Int. Cl.
*A45C 7/00* (2006.01)
*A45C 5/14* (2006.01)
*A45C 13/10* (2006.01)

(52) U.S. Cl.
CPC ..... *A45C 7/0077* (2013.01); *A45C 5/143* (2013.01); *A45C 13/103* (2013.01); *A45C 13/1069* (2013.01)

(58) Field of Classification Search
CPC ..... A45C 7/0077; A45C 5/143; A45C 13/103; A45C 13/1069

(Continued)

(56) References Cited

U.S. PATENT DOCUMENTS 2,349,025 A * 5/1944 Wick ..... A45C 3/04 383/2
3,031,121 A * 4/1962 Chase ..... B65D 81/3858 383/110

(Continued)

FOREIGN PATENT DOCUMENTS

WO 2014068545 A1 5/2014

OTHER PUBLICATIONS

U.S. Appl. No. 18/419,002; filed on Jan. 22, 2024; 33 pages.
U.S. Appl. No. 18/420,113; filed on Jan. 23, 2024; 40 pages.

*Primary Examiner* — Sue A Weaver
(74) *Attorney, Agent, or Firm* — Taft Stettinius & Hollister LLP

(57) ABSTRACT

A tote bag including a collapsible container body made of a foldable assembly of fabric panels joined together to form a bottom side and a sidewall including four lateral sides that jointly define an inner storage volume when the collapsible container body takes an expanded state. Opposite first and second lateral sides of the collapsible container body are each provided with a gusset fold designed to allow outward folding of the first and second lateral sides into flat-folded gusset sections. The collapsible container body is configured to be foldable into a flattened folded configuration where the first and second lateral sides are folded outward along the gusset fold into the flat-folded gusset sections, which are in turn foldable inward over lateral sections of a third one of the lateral sides, while a fourth one of the lateral sides is foldable inward to align the bottom side with the fourth lateral side. The collapsible container body is provided with a releasable holding structure to selectively secure the flat-folded gusset sections to the third lateral side and keep the collapsible container body in the flattened folded configuration.

23 Claims, 8 Drawing Sheets

(58) Field of Classification Search
USPC ..... 383/2
See application file for complete search history.

(56) References Cited

U.S. PATENT DOCUMENTS

| | | | | |
|---|---|---|---|---|
| D413,723 | S * | 9/1999 | Quansah | D3/234 |
| 7,160,028 | B1 * | 1/2007 | Linday | A45C 9/00 150/108 |
| 7,845,508 | B2 * | 12/2010 | Rothschild | A45F 4/02 220/4.08 |
| 8,469,249 | B2 * | 6/2013 | Sugano | A45F 3/04 224/584 |
| D688,449 | S | 8/2013 | Schinasi | |
| 9,999,282 | B2 | 6/2018 | Schinasi | |
| 10,238,194 | B2 * | 3/2019 | Turpeau | A45C 5/14 |
| 10,376,030 | B1 * | 8/2019 | Koh | B62B 3/02 |
| 10,689,156 | B2 * | 6/2020 | Sawachi | B65D 25/54 |
| 2006/0198562 | A1 * | 9/2006 | Mogil | A45C 7/0077 383/121.1 |
| 2021/0227943 | A1 * | 7/2021 | Gaye | A45C 3/04 |

* cited by examiner

FOLDABLE TOTE BAG WITH COLLAPSIBLE CONTAINER BODY

TECHNICAL FIELD

The present invention generally relates to a multipurpose tote bag as for instance used as shopping bag, grocery bag and/or laundry bag.

BACKGROUND OF THE INVENTION

Tote bags are known as such in the art.

International (PCT) Publication No. WO 2014/068545 A1 and related U.S. Pat. No. 9,999,282 B2, the contents of which are incorporated herein by reference, disclose a tote bag comprising a collapsible container body made of a foldable assembly of fabric panels that are joined together to form a bottom side and a sidewall including four lateral sides that jointly define an inner storage volume when the collapsible container body takes an expanded state. This tote bag further comprises a removable rolling support assembly to provide rolling support for the collapsible container body in the expanded state, the removable rolling support assembly including a support plate and a plurality of caster wheels provided on an underside of the support plate. More specifically, the tote bag is constructed such that the support plate can be inserted inside the inner storage volume and be removably attached at the bottom of the collapsible container body by means of a pair of inner securing flaps. The bottom side of the collapsible container body is furthermore provided with apertures to allow passage of the caster wheels therethrough in order to project away from the bottom side on the underside of the collapsible container body.

Yet another example of a similar tote bag with a removable rolling support assembly is disclosed in U.S. Design Pat. No. D688,499 S, the tote bag being likewise constructed such that the rolling support assembly can be inserted inside the inner storage volume and removably attached at the bottom of the collapsible container body, with the caster wheels projecting away from the bottom side through corresponding apertures formed therein to provide rolling support for the collapsible container body.

Improvements of the aforementioned tote bags further form the subject-matter of European patent application No. 23159231.2 of Feb. 28, 2023 (see also related U.S. patent application Ser. No. 18/419,002 of Jan. 22, 2024), titled "ROLLING TOTE BAG", and European patent application No. 23163069.0 of Mar. 21, 2023 (see also related U.S. patent application Ser. No. 18/420,113 of Jan. 23, 2024), titled "TOTE BAG AND METHOD OF FORMING A SIDEWALL THEREOF", all in the name of the present Applicant, the contents of which are incorporated herein by reference.

A tote bag embodying the aforementioned improvements is available on the market in various sizes and colours under the product designation HULKEN®(cf. https://hulkenbag.com/). FIG. 1 is a photographic illustration of such a tote bag B comprising a collapsible container body 10 made of a foldable assembly of fabric panels that are joined together to form a bottom side 15 and a sidewall 11-14 including four lateral sides 11, 12, 13, 14 that jointly define an inner storage volume when the collapsible container body 10 takes an expanded state, as shown in FIG. 1. A particularity of the tote bag B shown in FIG. 1 resides in that opposite first and second lateral sides 11, 13 of the collapsible container body 10 are each provided with a gusset fold F (as schematically shown in FIG. 2) designed to allow outward folding of the first and second lateral sides 11, 13 into flat-folded gusset sections 11F, 13F as shown schematically in FIGS. 3A and 3B. More specifically, the collapsible container body 10 is configured to be foldable into a flattened folded configuration (e.g. for storage purposes), as further shown in FIG. 4, where the first and second lateral sides 11, 13 are folded outward along the gusset fold F into the flat-folded gusset sections 11F, 13F, the flat-folded gusset sections 11F, 13F being folded inward over lateral sections of a third one of the lateral sides 11, 12, 13, 14 (namely lateral side 14), while a fourth one of the lateral sides 11, 12, 13, 14 (namely lateral side 12) is folded inward to align the bottom side 15 with the fourth lateral side 12, thereby leading to a particularly compact configuration for storage and/or transport purposes. As shown in FIG. 4, one of the upper handles H2 of the tote bag B may be used to maintain the collapsible container body 10 substantially in the flattened folded configuration, namely by folding the handle H2 onto an upper part of the flat-folded gusset sections 11F, 13F and sticking the handle H2 into a side handle H provided on the third lateral side 14.

The aforementioned solutions are reasonably satisfactory but suffer from certain limitations. In particular, while the collapsible container body 10 can be folded into the flattened folded configuration shown in FIG. 4, using the handles H, H2 to maintain the tote bag B in this configuration is not a sufficiently robust solution as one or both of the flat-folded gusset sections 11F, 13F may get dislodged relatively easily. Furthermore, not all users are necessarily familiar with the manner in which the collapsible container body 10 can and should preferably be folded.

There therefore remains a need for an improved solution.

SUMMARY OF THE INVENTION

A general aim of the invention is to provide a tote bag that obviates the problems and limitations of known tote bags.

More specifically, an aim of the invention is to provide such a tote bag that retains the functionalities and benefits of the known HULKEN® bag, while improving its ability to be kept in a compact configuration for storage and/or transport purposes.

A further aim of the invention is to provide such a tote bag that is cost-efficient to produce.

These aims and others are achieved thanks to the solutions defined in the claims.

In accordance with the invention, there is provided a tote bag, the features of which are recited in claim 1, namely such a tote bag comprising a collapsible container body made of a foldable assembly of fabric panels that are joined together to form a bottom side and a sidewall including four lateral sides that jointly define an inner storage volume when the collapsible container body takes an expanded state. Opposite first and second lateral sides of the collapsible container body are each provided with a gusset fold designed to allow outward folding of the first and second lateral sides into flat-folded gusset sections. Furthermore, the collapsible container body is configured to be foldable into a flattened folded configuration where the first and second lateral sides are folded outward along the gusset fold into the flat-folded gusset sections, the flat-folded gusset sections being foldable inward over lateral sections of a third one of the lateral sides, while a fourth one of the lateral sides is foldable inward to align the bottom side with the fourth lateral side. According to the invention, the collapsible container body is provided with a releasable holding structure to selectively secure the flat-folded gusset sections to the third lateral side and keep the collapsible container body in the flattened folded configuration.

In accordance with one embodiment, the releasable holding structure comprises fasteners provided on an outer side of the sidewall, including a first pair of fasteners each provided on a portion of a corresponding one of the first and second lateral sides and a second pair of fasteners provided on the third lateral side for selective cooperation with the first pair of fasteners. The fasteners are preferably hook-and-loop fasteners or, alternatively, snap fasteners.

In accordance with another embodiment, the releasable holding structure comprises magnets provided on the sidewall, including a first pair of magnets each provided on a portion of a corresponding one of the first and second lateral sides and a second pair of magnets provided on the third lateral side for selective cooperation with the first pair of magnets. The magnets are preferably integrated within the sidewall to conceal the magnets from view.

In accordance with a particularly preferred embodiment, the releasable holding structure comprises a pair of stretchable elastic bands each provided on a portion of a corresponding one of the first and second lateral sides and at least one retaining element provided on the third lateral side for selective cooperation with the stretchable elastic bands, each of the stretchable elastic bands being configured to be selectively stretched such as to be brought into selective cooperation with the at least one retaining element. Each stretchable elastic band may advantageously be provided along a portion of the gusset fold and comprise first and second ends secured to the portion of the first or second lateral side and a stretchable midsection that can be brought into selective cooperation with the at least one retaining element.

The at least one retaining element may especially include a button standing out from the third lateral side.

The at least one retaining element may furthermore be provided on a side handle secured to the third lateral side.

Advantageously, the sidewall includes a pair of opposite short lateral sides and a pair of opposite long lateral sides and is preferably formed of two side panels joined at extremities along two vertical connection lines each coinciding with a vertical midline of a corresponding one of the short lateral sides, each of the two side panels being pinched along two distinct pinching lines to form four vertical ridges.

The tote bag may further comprise a releasable cover panel that forms an integral part of the collapsible container body, which releasable cover panel is provided at an upper end of the sidewall to allow selective closure of the inner storage volume when the collapsible container body is in the expanded state. In this latter context, the releasable cover panel may especially be permanently attached to one of the lateral sides and releasably attachable to the remaining ones of the lateral sides, preferably by means of a zipper, to close the inner storage volume.

The tote bag may further comprise a rolling support assembly to provide rolling support for the collapsible container body in the expanded state, the rolling support assembly including a support plate and a plurality of caster wheels provided on an underside of the support plate. The collapsible container body may further comprise a retaining structure configured to securely hold the support plate outside of the inner storage volume against an underside of the bottom side.

The sidewall may be made one or more side panels each comprising at least two outer pieces of fabric and an intermediate piece of packing material, in particular bubble wrap, interposed between the two outer pieces of fabric. Furthermore, the outer pieces of fabric may be made of or comprise at least one sheet of woven fabric produced out of strands of synthetic or non-synthetic material, such as polypropylene (PP) strands. By way of preference, one or each of the outer pieces of fabric may further comprise an outer layer, such as a biaxially-oriented polypropylene (BOPP) film, a cast polypropylene (CPP) film or polypropylene (PP) coating, that is applied on an outer side of the sheet of woven fabric, for instance by lamination or extrusion coating.

Further advantageous embodiments of the invention are discussed below.

BRIEF DESCRIPTION OF THE DRAWINGS

Other features and advantages of the present invention will appear more clearly from reading the following detailed description of embodiments of the invention which are presented solely by way of non-restrictive examples and are illustrated by the appended drawings in which.

DETAILED DESCRIPTION OF EMBODIMENTS OF THE INVENTION

The present invention will be described in relation to various illustrative embodiments as shown in particular in FIGS. 1 to 7A. It shall be understood that the scope of the invention encompasses all combinations and sub-combinations of the features of the invention disclosed herein as defined by the appended claims.

Figure 1:
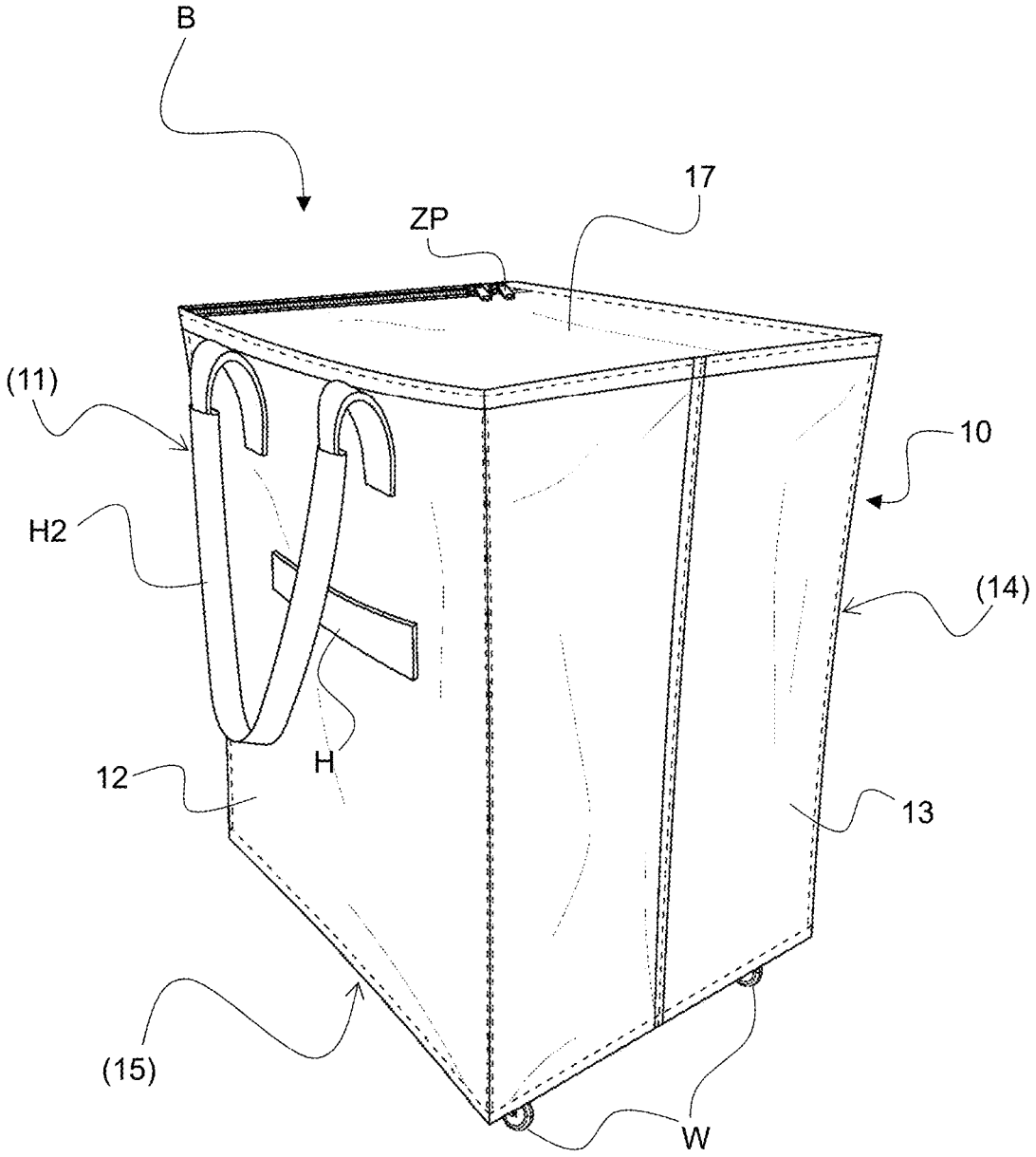
FIG. 1 is a photographic illustration of a known tote bag comprising a collapsible container body, the tote bag being shown with the collapsible container body in an expanded state.

FIG. 1 is a photographic illustration of a known tote bag B as discussed in greater detail in European patent application No. 23163069.0 of Mar. 21, 2023 and related U.S. patent application Ser. No. 18/420,113 of Jan. 23, 2024, both titled "TOTE BAG AND METHOD OF FORMING A SIDEWALL THEREOF", in the name of the present Applicant. The tote bag B comprises a collapsible container body 10 that is made of a foldable assembly of fabric panels that are joined together to form a bottom side 15 and a sidewall 11 14 including four lateral sides 11, 12, 13, 14, namely a pair of short lateral sides 11, 13 and a pair of long lateral sides 12, 14. The bottom side 15 and four lateral sides 11, 12, 13, 14 jointly define an inner storage volume when the collapsible container body 10 is in the expanded state as shown in FIG. 1. As can be seen in FIG. 1, four vertical ridges shape the sidewall 11-14 into the four lateral sides 11, 12, 13 and 14.

The tote bag B further comprises a rolling support assembly S (as shown in the schematic illustration of FIG. 2) to provide rolling support for the collapsible container body 10 in the expanded state. The rolling support assembly S includes a support plate P and a plurality of caster wheels W provided on an underside of the support plate P. The caster wheels W are partly visible in FIG. 1.

The support plate P may be made of any desired material and exhibit any adequate structure. Light-weight materials and structures are preferred. In particular, the support plate P may be made of board of synthetic material including a honeycomb spacer structure that ensures adequate rigidity and strength, while remaining light-weight.

The rolling support assembly S is preferably removably attached to the underside of the tote bag B, namely underneath the bottom side 15, by means of a releasable retaining structure 21-24 (one possible embodiment being shown in FIG. 2), which will not be described extensively as it forms the subject-matter of European patent application No. 23159231.2 of Feb. 28, 2023 and related U.S. patent application Ser. No. 18/419,002 of Jan. 22, 2024, both titled "ROLLING TOTE BAG", in the name of the present Applicant.

In the illustrated example, multiple handles H1, H2, H are secured to the lateral sides 11, 12, 13, 14, including a pair of handles H2 secured to the opposite long lateral sides 12, 14, a third handle H1 secured on one of the short lateral sides 11, 13, namely short lateral side 11 in the illustrated example, to facilitate rolling of the tote bag B in use, as well as a pair of side handles H secured to the opposite long lateral sides 12, 14.

Figure 2:
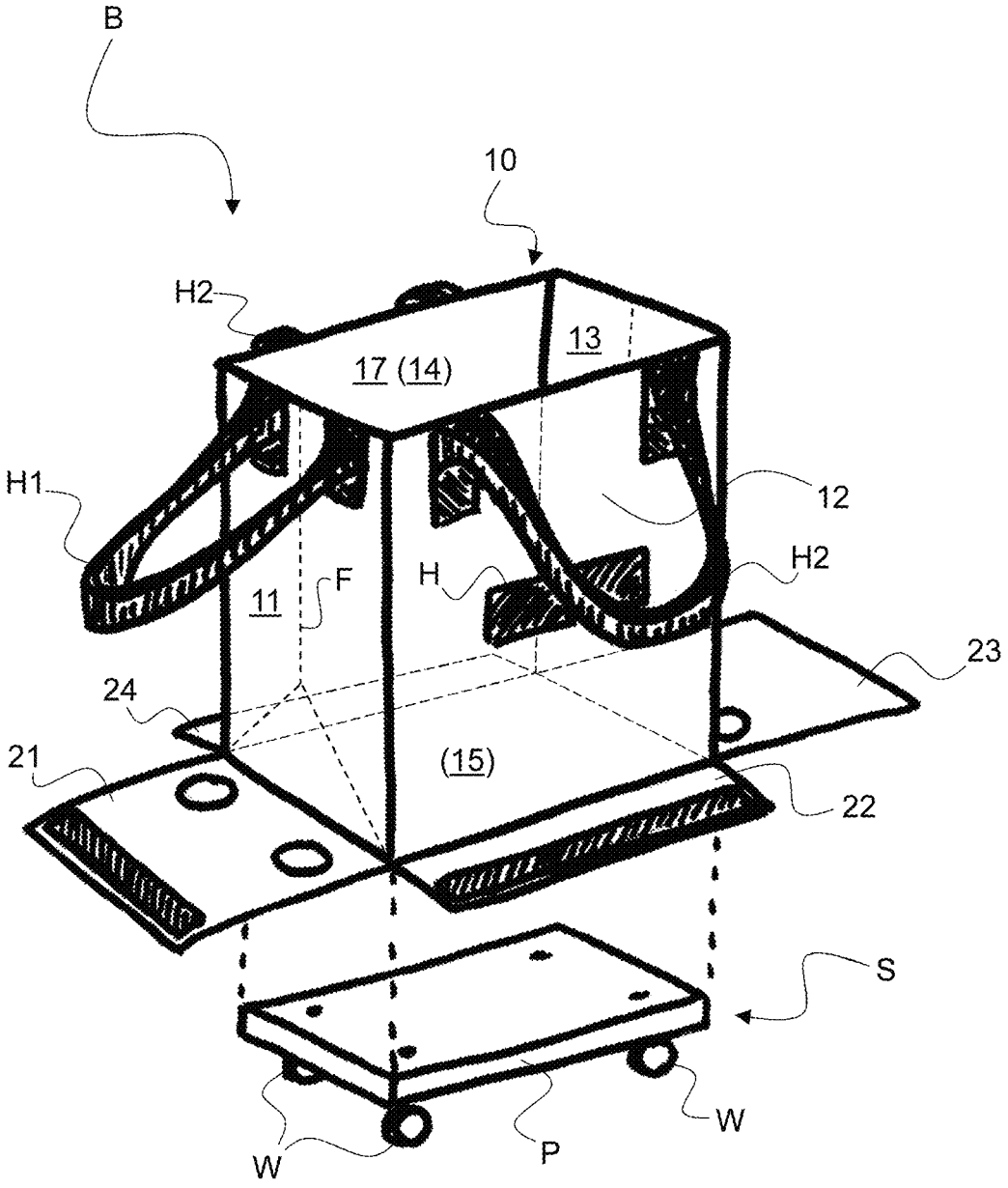
FIG. 2 is a schematic illustration of a known tote bag showing the collapsible container body of the tote bag in an expanded state, detached from a rolling support assembly.

The sidewall 11-14 is preferably formed of two side panels joined at extremities along two vertical connection lines each coinciding with a vertical midline of a corresponding one of the short lateral sides 11, 13, each of the two side panels being pinched along two distinct pinching lines to form the four vertical ridges. An advantage of this solution resides in that both vertical connection lines extend partly along a portion of the relevant gusset folds F formed on the short lateral sides 11, 13 (as schematically shown in FIG. 2), which helps imparting a slightly hexagonal shape to the collapsible container body 10 and assist folding of the tote bag B as discussed with reference to FIGS. 3A-B and 4. Other solutions may however be contemplated as further discussed in European patent application No. 23163069.0 of Mar. 21, 2023 and related U.S. patent application Ser. No. 18/420,113 of Jan. 23, 2024.

Also visible in FIG. 1 is a releasable cover panel 17 that forms an integral part of the collapsible container body 10. This releasable cover panel 17 is provided at an upper end of the sidewall 11-14 to allow selective closure of the inner storage volume when the collapsible container body 10 is in the expanded state, as shown in the illustration of FIG. 1. More specifically, the releasable cover panel 17 is permanently attached to one of the lateral sides 11, 12, 13, 14 (here long lateral side 14) and releasably attachable to the remaining ones of the lateral sides 11, 12, 13, 14 (namely lateral sides 11, 12, 13) to close the inner storage volume. By way of preference, cover panel 17 is releasably attached to the relevant lateral sides by means of a zipper ZP.

The collapsible container body 10 is advantageously constructed such that the sidewall 11-14 is made of one or more sides panels each comprising at least two outer pieces of fabric and an intermediate piece of packing material, in particular bubble wrap, interposed between the two outer pieces of fabric, as taught by International (PCT) Publication No. WO 2014/068545 A1 and related U.S. Pat. No. 9,999,282 B2, the contents of which are incorporated herein by reference in that regard. This provides some level of structural reinforcement to the collapsible container body 10 which can retain its expanded state, while still allowing the collapsible container body 10 to be folded to a compact configuration for storage.

The outer pieces of fabric may especially be made of or comprise at least one sheet of woven fabric produced out of polypropylene (PP) strands. Other synthetic or non-synthetic materials could however be contemplated without departing from the scope of the invention as defined by the appended claims. Preferably, one or each of the outer pieces of fabric further comprises an outer layer, such as but not limited to a biaxially-oriented polypropylene (BOPP) film that is laminated on an outer side of the sheet of woven fabric, which allows customization of the appearance of either one or both of the external and internal visible sides of the collapsible container body 10. Lamination of a BOPP film is advantageously contemplated, but the outer layer could be applied in any other suitable manner. Alternatives may consist in the lamination of a cast polypropylene (CPP) film or the application of a polypropylene (PP) coating by extrusion coating.

Figure 3A:
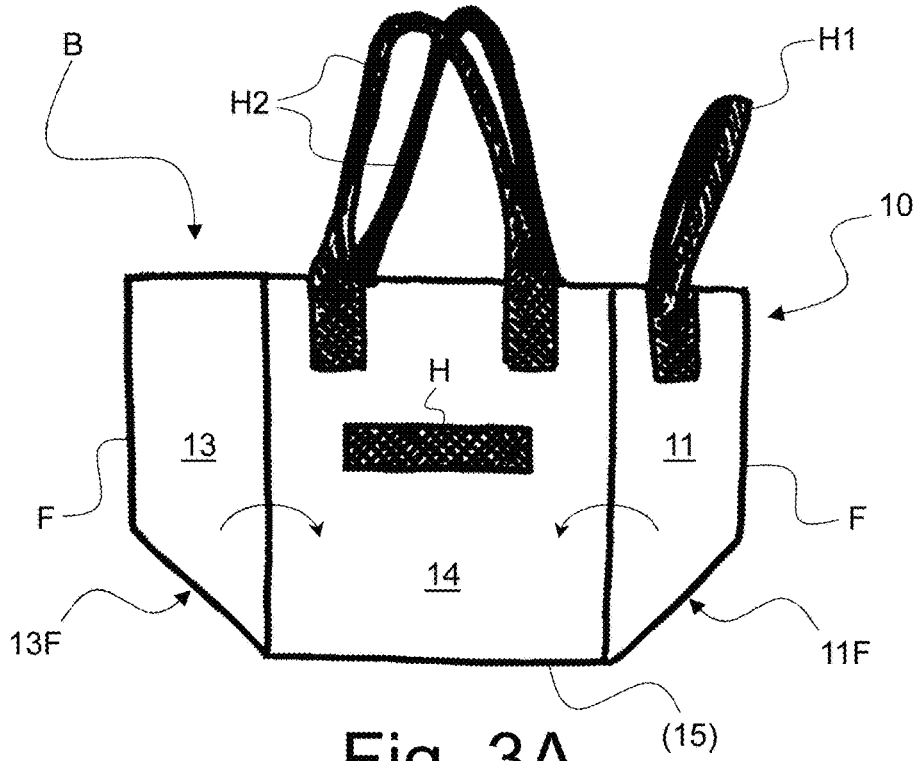
FIGS. 3A and 3B are schematic illustrations of the tote bag of FIG. 2 partially folded into a flattened folded configuration as shown from two opposite long lateral sides.
Figure 3B:
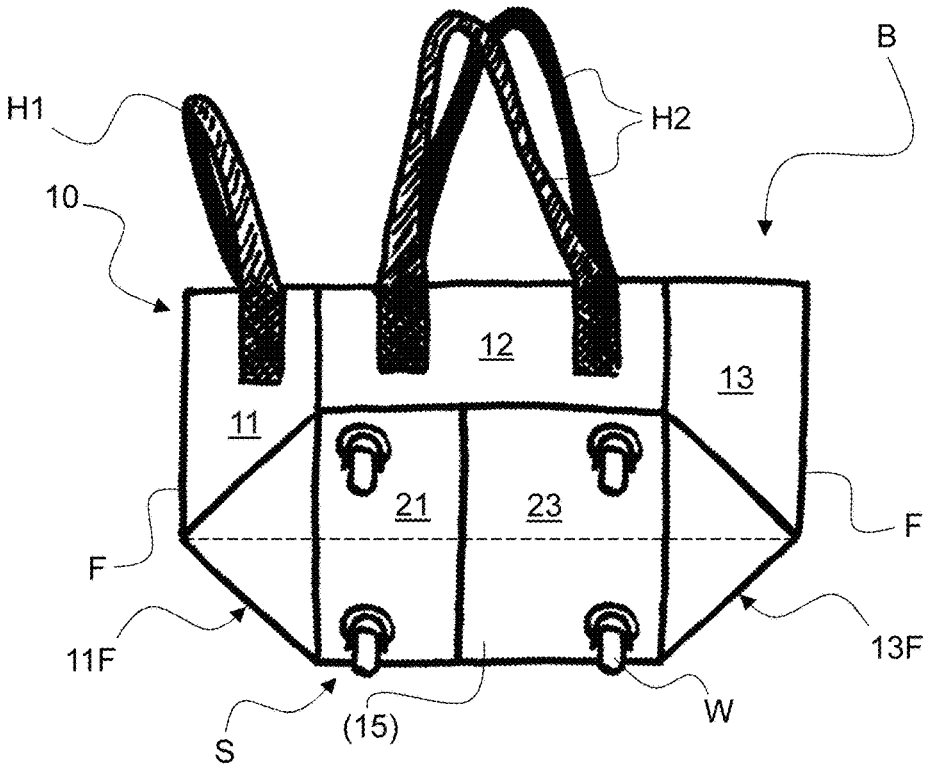
Figure 4:
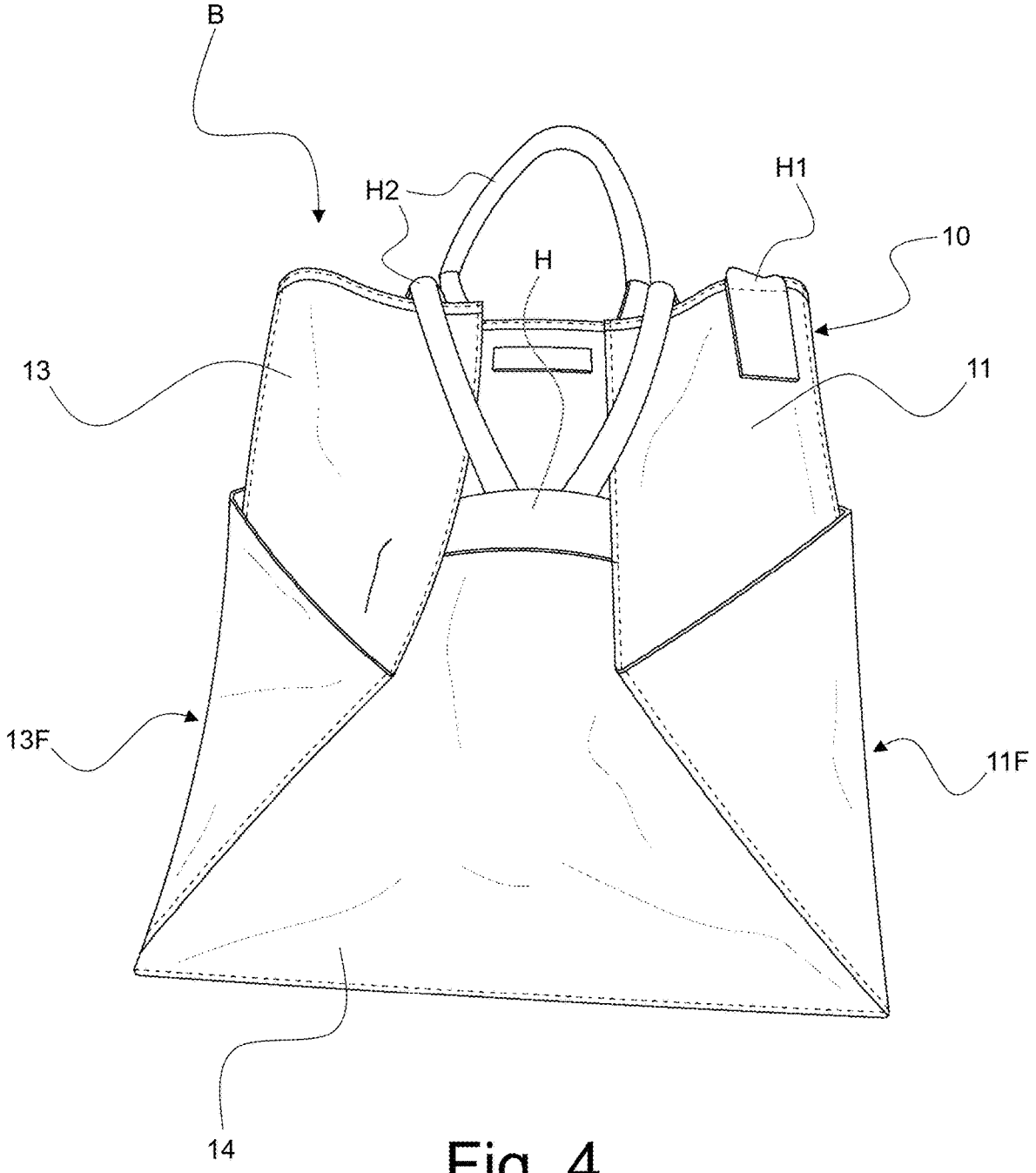
FIG. 4 is a photographic illustration of a known tote bag showing the collapsible container body fully folded into the flattened folded configuration.

The collapsible container body 10 is configured to be foldable into a flattened folded configuration (as shown in FIGS. 3A-B and 4). To this end, each of the opposite short lateral sides 11, 13 is provided with a gusset fold F (as shown schematically in FIG. 2) designed to allow outward folding of the opposite short lateral sides 11, 13, as shown schematically in FIGS. 3A and 3B, into flat-folded gusset sections 11F, 13F. Such flat-folded gusset sections 11F, 13F may conveniently be folded inward over lateral sections of a first one of the long lateral sides 12, 14 (here lateral side 14), as indicated schematically by the pair of arrows in FIG. 3A, while the second, opposite long lateral side 12 of the collapsible container body 10 is folded inward, along a horizontal fold, to align the bottom side 15 and associated rolling support assembly S with the second long lateral side 12, as shown in FIG. 3B.

According to the invention, the collapsible container body 10 is provided with a releasable holding structure (as discussed with reference to FIGS. 5 to 7 and 7A) to selectively secure the flat-folded gusset sections 11F, 13F to the third lateral side 14 and keep the collapsible container body 10 in the flattened folded configuration.

Figure 5:
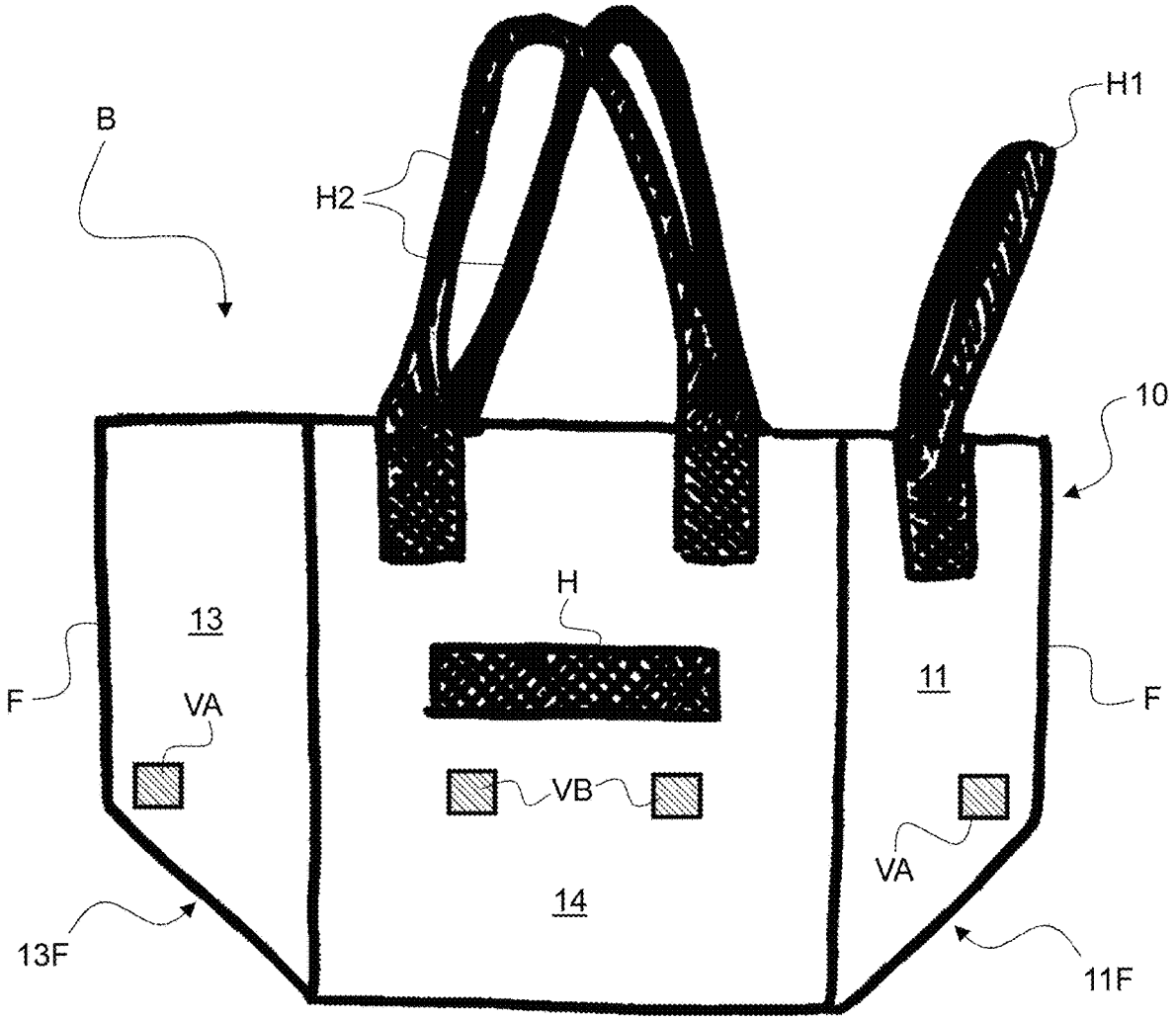
FIG. 5 is a schematic illustration of a tote bag in accordance with a first embodiment of the invention, which tote bag is shown partially folded into a flattened folded configuration.

FIG. 5 is a schematic illustration of a tote bag B in accordance with a first embodiment of the invention, where the releasable holding structure VA/VB comprises fasteners VA, VB provided on an outer side of the sidewall 11-14. In the illustrated example, the releasable holding structure VA/VB comprises a first pair of fasteners VA, each provided on a portion of a corresponding one of the first and second lateral sides 11, 13, and a second pair of fasteners VB that are provided on the third lateral side 14 for selective cooperation with the first pair of fasteners VA. The fasteners VA, VB may especially be hook-and-loop fasteners or, alternatively, snap fasteners. In this case, one will understand that each fastener VA is brought into selective cooperation with the associated fastener VB upon inward folding of the flat-folded gusset sections 11F, 13F onto lateral side 14.

The solution depicted schematically in FIG. 5 ensures that the collapsible container body 10 can be reliably maintained in the flattened folded configuration for storage and/or transport purposes. One limitation, however, resides in the visible provision of the fasteners VA, VB which may impact the overall visual appearance of the tote bag B.

Figure 6:
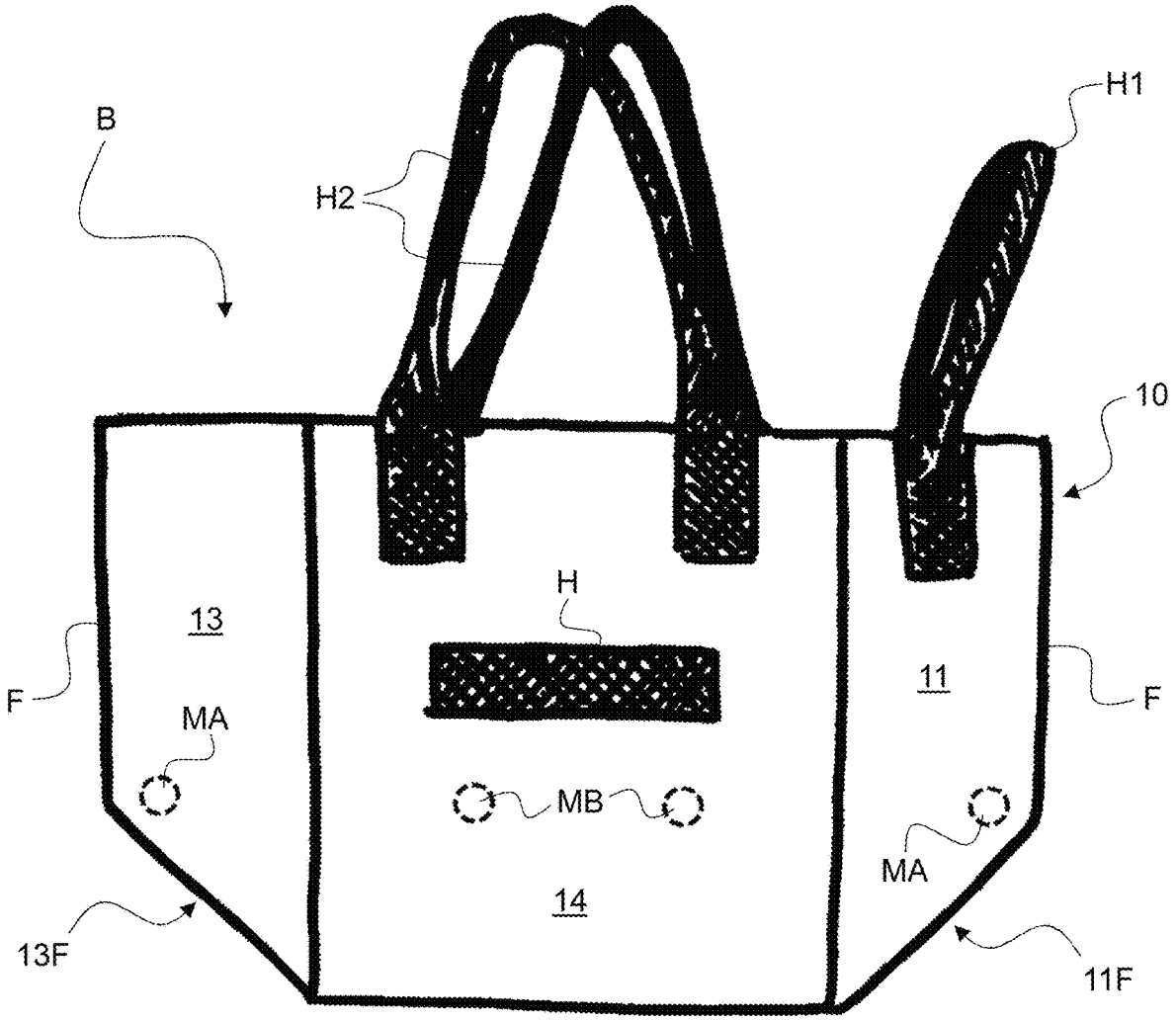
FIG. 6 is a schematic illustration of a tote bag in accordance with a second embodiment of the invention, which tote bag is shown partially folded into a flattened folded configuration.

FIG. 6 is a schematic illustration of a tote bag B in accordance with another embodiment of the invention, where the releasable holding structure MA/MB comprises magnets MA, MB provided on the sidewall 11-14. In the illustrated example, the releasable holding structure MA/MB comprises a first pair of magnets MA, each provided on a portion of a corresponding one of the first and second lateral sides 11, 13, and a second pair of magnets MB that are provided on the third lateral side 14 for selective cooperation with the first pair of magnets MA. In this case, one will understand that each magnet MA is brought into selective cooperation with the associated magnet MB upon inward folding of the flat-folded gusset sections 11F, 13F onto lateral side 14.

By way of preference, the magnets MA, MB are integrated within the sidewall 11-14 to conceal the magnets MA, MB from view, leading to a more elegant solution from an aesthetic perspective.

Figure 7:
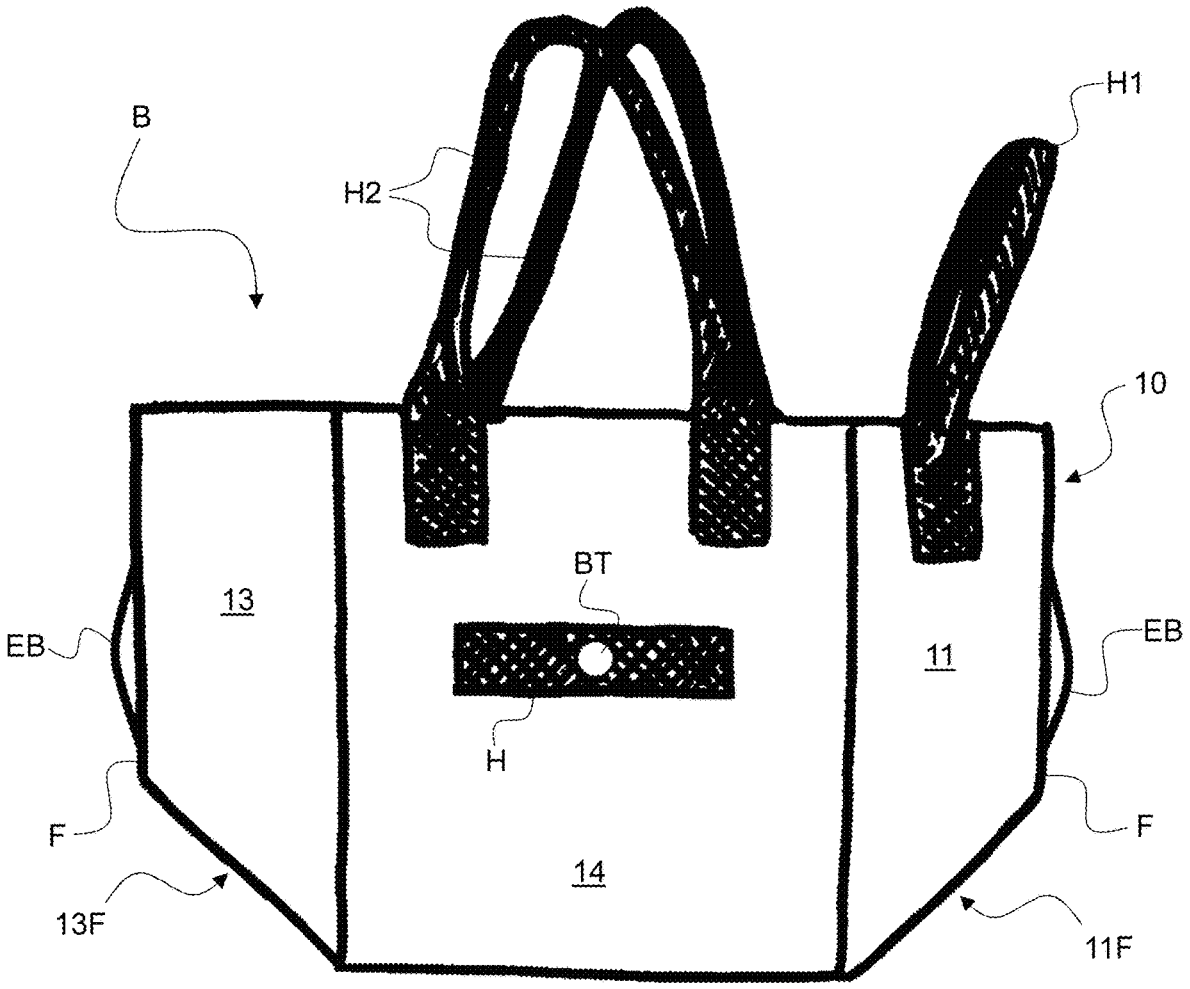
FIG. 7 is a schematic illustration of a tote bag in accordance with a third embodiment of the invention, which tote bag is shown partially folded into a flattened folded configuration.

FIG. 7 is a schematic illustration of a tote bag B in accordance with a further embodiment of the invention. In this case, the releasable holding structure BT/EB comprises a pair of stretchable elastic bands EB, each provided on a portion of a corresponding one of the first and second lateral sides 11, 13, and at least one retaining element BT provided on the third lateral side 14 for selective cooperation with the stretchable elastic bands EB. More specifically, each of the stretchable elastic bands EB is configured to be selectively stretched such as to be brought into selective cooperation with the at least one retaining element BT.

Figure 7A:
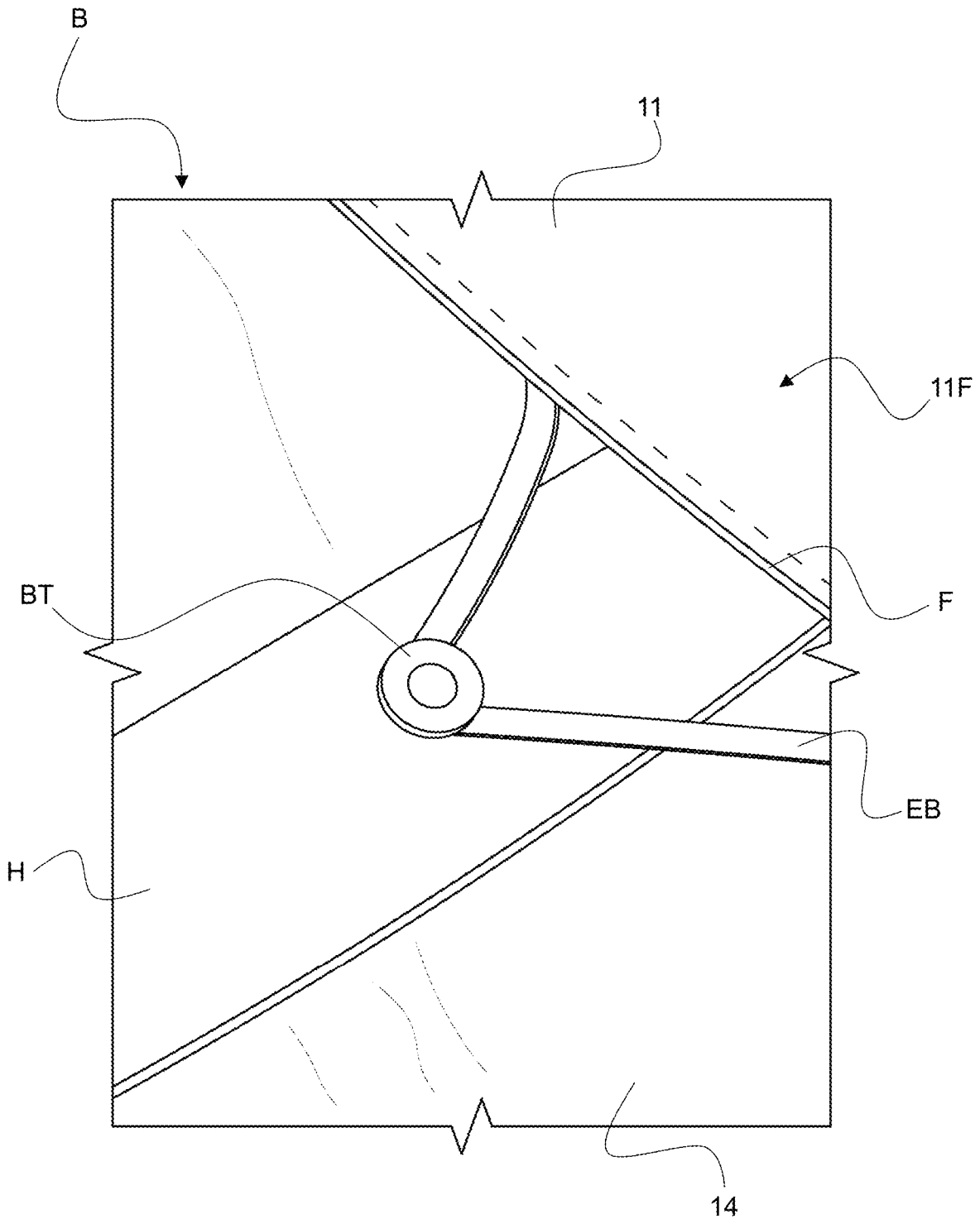
FIG. 7A is a photographic illustration showing part of the tote bag in accordance with the third embodiment of FIG. 7 shown in the flattened folded configuration.

In the illustrated example, each stretchable elastic band EB is preferably provided along a portion of the gusset fold F and comprises first and second ends secured to the portion of the first or second lateral side 11, 13 and a stretchable midsection that can be brought into selective cooperation with the at least one retaining element BT, as shown in the photographic illustration of FIG. 7A.

The retaining element may especially include a button BT standing out from the third lateral side 14. More specifically, in the illustrated example, the retaining element BT is provided on the side handle H that is secured to the third lateral side 14, which is preferable in that this avoids piercing of the third lateral side 14, which could damage the fabric material of the sidewall 11-14.

While FIG. 7 shows a single button BT that is in effect used as a common retaining element for both stretchable elastic bands EB, two separate retaining elements could be provided, namely one retaining element BT for each stretchable elastic band EB.

Various modifications and/or improvements may be made to the above-described embodiments without departing from the scope of the invention as defined by the appended claims. For instance, while a zipper is preferably used to releasably attach the cover panel to the relevant lateral sides of the collapsible container body, other solutions could be contemplated, including hook-and-loop or snap fasteners. In addition, while preferred, the releasable cover panel constitutes an optional feature that may be omitted entirely.

LIST OF REFERENCE NUMERALS AND SIGNS USED THEREIN

B tote bag (first embodiment)
10 collapsible (foldable) container body of tote bag B
11 (first) short lateral side of collapsible container body 10 (part of sidewall 11-14)
12 (first) long lateral side of collapsible container body 10 (part of sidewall 11-14)
13 (second) short lateral side of collapsible container body 10 (part of sidewall 11-14)
14 (second) long lateral side of collapsible container body 10 (part of sidewall 11-14)
F gusset fold formed on each short lateral side 11, 13
11F flat-folded gusset section formed by outward folding of short lateral side 11 along gusset fold F
13F flat-folded gusset section formed by outward folding of short lateral side 13 along gusset fold F
15 bottom side of collapsible container body 10
17 releasable cover panel forming an integral part of the collapsible container body 10 (permanently attached to long lateral side 14)
ZP zipper for releasably attaching cover panel 17 to remaining lateral sides 11, 12, 13
S rolling support assembly removably attached to bottom side of collapsible container body 10
P support plate
W caster wheels provided on underside of support plate P
H, H1, H2 handles
21-24 retaining structure for attachment of rolling support assembly S to bottom side of collapsible container body 10
VA, VB fasteners (e.g. hook-and-loop fasteners)/releasable holding structure (embodiment of FIG. 5)
MA, MB magnets/releasable holding structure (embodiment of FIG. 6)
BT retaining element/button/part of releasable holding structure (embodiment of FIGS. 7 and 7A)
EB stretchable elastic bands/part of releasable holding structure (embodiment of FIGS. 7 and 7A)

The invention claimed is:

1. A tote bag comprising a collapsible container body made of a foldable assembly of fabric panels that are joined together to form a bottom side and a sidewall including four lateral sides that jointly define an inner storage volume when the collapsible container body takes an expanded state, wherein opposite first and second lateral sides of the collapsible container body are each provided with a gusset fold designed to allow outward folding of the first and second lateral sides into flat-folded gusset sections, wherein the collapsible container body is configured to be foldable into a flattened folded configuration where the first and second lateral sides are folded outward along the gusset fold into the flat-folded gusset sections, the flat-folded gusset sections being foldable inward over lateral sections of a third one of the lateral sides, while a fourth one of the lateral sides is foldable inward to align the bottom side with the fourth lateral side, and wherein the collapsible container body is provided with a releasable holding structure to selectively secure the flat-folded gusset sections to the third lateral side and keep the collapsible container body in the flattened folded configuration.

2. The tote bag according to claim 1, wherein the releasable holding structure comprises fasteners provided on an outer side of the sidewall, including a first pair of fasteners each provided on a portion of a corresponding one of the first and second lateral sides and a second pair of fasteners provided on the third lateral side for selective cooperation with the first pair of fasteners.

3. The tote bag according to claim 2, wherein the fasteners are hook-and-loop fasteners or snap fasteners.

4. A tote bag comprising a collapsible container body made of a foldable assembly of fabric panels that are joined together to form a bottom side and a sidewall including four lateral sides that join define an inner storage volume when the collapsible container body takes an expanded state, wherein opposite first and second lateral sides of the collapsible container body are each provided with a gusset fold designed to allow outward folding of the first and second lateral sides into flat-folded gusset sections, wherein the collapsible container body is configured to be foldable into a flattened folded configuration where the first and second lateral sides are folded outward along the gusset fold into the flat-folded gusset sections, the flat-folded gusset sections being foldable inward over lateral sections of a third one of the lateral sides, while a fourth one of the lateral sides is foldable inward to align the bottom side with the fourth lateral side, wherein the collapsible container body is provided with a releasable holding structure to selectively secure the flat-folded gusset sections to the third lateral side and keep the collapsible container body in the flattened folded configuration:

and wherein the releasable holding structure comprises magnets provided on the sidewall, including a first pair of magnets each provided on a portion of a corresponding one of the first and second lateral sides and a second pair of magnets provided on the third lateral side for selective cooperation with the first pair of magnets.

5. The tote bag according to claim 4, wherein the magnets are integrated within the sidewall to conceal the magnets from view.

6. A tote bag comprising a collapsible container body made of a foldable assembly of fabric panels that are joined together to form a bottom side and a sidewall including four lateral sides that jointly define an inner storage volume when the collapsible container body takes an expanded state, wherein opposite first and second lateral sides of the collapsible container body are each provided with a gusset fold designed to allow outward folding of the first and second lateral sides into flat-folded gusset sections;

wherein the collapsible container body is configured to be foldable into a flattened folded configuration where the first and second lateral sides are folded outward along the gusset fold into the flat-folded gusset sections, the flat-folded gusset sections being foldable inward over lateral sections of a third one of the lateral sides, while a fourth one of the lateral is foldable inward to alien the bottom side with the fourth lateral side, wherein the collapsible container body is provided with a releasable holding structure to selectively secure the flat-folded gusset sections to the third lateral side and keep the collapsible container body in the flattened folded configuration, and wherein the releasable holding structure comprises a pair of stretchable elastic bands each provided on a portion of a corresponding one of the first and second lateral sides and at least one retaining element provided on the third lateral side for selective cooperation with the stretchable elastic bands, each of the stretchable elastic bands being configured to be selectively stretched such as to be brought into selective cooperation with the at least one retaining element.

7. The tote bag according to claim 6, wherein each stretchable elastic band is provided along a portion of the gusset fold and comprises first and second ends secured to the portion of the first or second lateral side and a stretchable midsection that can be brought into selective cooperation with the at least one retaining element.

8. The tote bag according to claim 6, wherein the at least one retaining element includes a button standing out from the third lateral side.

9. The tote bag according to claim 6, wherein the at least one retaining element is provided on a side handle secured to the third lateral side.

10. The tote bag according to claim 1, wherein the sidewall includes a pair of opposite short lateral sides and a pair of opposite long lateral sides.

11. The tote bag according to claim 10, wherein the sidewall is formed of two side panels joined at extremities along two vertical connection lines each coinciding with a vertical midline of a corresponding one of the short lateral sides, each of the two side panels being pinched along two distinct pinching lines to form vertical ridges.

12. The tote bag according to claim 1, further comprising a releasable cover panel that forms an integral part of the collapsible container body, which releasable cover panel is provided at an upper end of the sidewall to allow selective closure of the inner storage volume when the collapsible container body is in the expanded state.

13. The tote bag according to claim 12, wherein the releasable cover panel is permanently attached to one of the lateral sides and releasably attachable to the remaining ones of the lateral sides to close the inner storage volume.

14. The tote bag according to claim 13, wherein the releasable cover panel is releasably attachable to the remaining ones of the lateral sides by means of a zipper.

15. The tote bag according to claim 1, further comprising a rolling support assembly to provide rolling support for the collapsible container body in the expanded state, the rolling support assembly including a support plate and a plurality of caster wheels provided on an underside of the support plate.

16. The tote bag according to claim 15, wherein the collapsible container body further comprises a retaining structure configured to securely hold the support plate outside of the inner storage volume against an underside of the bottom side.

17. The tote bag according to claim 1, wherein the sidewall is made of one or more side panels each comprising at least two outer pieces of fabric and an intermediate piece of packing material interposed between the two outer pieces of fabric.

18. The tote bag according to claim 17, wherein the intermediate piece of packing material is a piece of bubble wrap.

19. The tote bag according to claim 17, wherein the outer pieces of fabric are made of or comprise at least one sheet of woven fabric produced out of strands of synthetic or non-synthetic material.

20. The tote bag according to claim 19, wherein the strand are polypropylene (PP) strands.

21. The tote bag according to claim 19, wherein one or each of the outer pieces of fabric further comprises an outer layer that is applied on an outer side of the sheet of woven fabric.

22. The tote bag according to claim 21, wherein the outer layer is a biaxially-oriented polypropylene (BOPP) film, a cast polypropylene (CPP) film or polypropylene (PP) coating.

23. The tote bag according to claim 21, wherein the outer layer is applied by lamination or extrusion coating.

* * * * *